US005746030A

United States Patent [19]

Sannipoli, Sr.

[11] Patent Number: 5,746,030

[45] Date of Patent: May 5, 1998

[54] MULTIPLE LEVEL VAULT ASSEMBLY

[76] Inventor: Alfred L. Sannipoli, Sr., 33470 Mirage Mesa Cir., Temecula, Calif. 92592

[21] Appl. No.: 762,066

[22] Filed: Dec. 9, 1996

[51] Int. Cl.[6] ..... E04H 13/00

[52] U.S. Cl. ..... 52/136; 52/20; 52/137

[58] Field of Search ..... 2/136, 137, 134, 2/169.6, 19, 20, 139, 236.6, 283; 404/25, 26; 220/503, 544

[56] References Cited

U.S. PATENT DOCUMENTS

| | | | |
|---|---|---|---|
| 1,815,883 | 7/1931 | Davis | 52/137 |
| 2,024,047 | 12/1935 | Kropp | 52/137 |
| 2,034,633 | 3/1936 | Roberts | 52/136 |
| 3,501,874 | 3/1970 | Hahne | 52/20 |
| 4,861,186 | 8/1989 | Ferns | 52/20 X |

*Primary Examiner*—Creighton Smith

*Attorney, Agent, or Firm*—Brown, Martin, Haller & McClain, LLP

[57] ABSTRACT

A double depth vault has a floor and opposing spaced side walls and end walls forming a burial enclosure. An intermediate floor panel is mountable in the enclosure at a predetermined location spaced above the floor to divide the vault into a lower burial chamber and an upper burial chamber. Pairs of aligned vertical guide grooves are provided in opposing walls of the vault to extend from the open end towards the floor, terminating at the desired intermediate floor position. Opposite edges of the intermediate floor member facing the grooved walls of the vault each have at least two spaced projecting pins for engagement in the respective guide grooves as the intermediate floor member is lowered into the vault. The closed ends of the guide grooves provide stops for engagement by the respective pins to support the intermediate floor member at the desired height in the vault.

8 Claims, 2 Drawing Sheets

MULTIPLE LEVEL VAULT ASSEMBLY

BACKGROUND OF THE INVENTION

The present invention relates generally to cemetery vaults or crypts and is particularly concerned with multiple level vault arrangements to permit multiple, vertically spaced interments of spouses or family members, for example.

Double vaults are known in which a concrete vault or housing is of sufficient depth to hold two caskets in vertically spaced chambers. The vault is interred at the first burial, and the first casket is lowered onto the lower end or floor of the vault. An intermediate concrete floor is then lowered into the vault and seats on an intermediate ledge extending around the inner peripheral walls of the vault at the appropriate height. A removable cover is placed over the open, upper end of the vault. At the time of the next interment, the removable cover is removed and the second casket is lowered onto the intermediate floor. This arrangement is subject to some disadvantages since the intermediate floor is heavy and bulky, and is sometimes difficult to lower flat into position in the vault without jamming or binding against the walls of the vault. It is also difficult to lower the flat concrete floor into the vault, typically requiring two or more workers to lower it by hand.

SUMMARY OF THE INVENTION

It is an object of the present invention to provide a new and improved multiple level vault assembly.

According to the present invention, a multiple level vault assembly is provided, which comprises a vault having a floor, a pair of opposing spaced side walls and pair of opposing spaced end walls forming a burial enclosure having an open upper end, each wall of at least one of the wall pairs having at least two guide grooves extending from the open end towards the floor and terminating at a location corresponding to a desired intermediate floor height, each guide groove being aligned with a corresponding guide groove in the opposite wall, an intermediate floor member for positioning in the vault between the open upper end and the floor to divide the vault into two, vertically spaced burial chambers, the intermediate floor member having a first pair of opposite edges facing the respective grooved walls of the vault, each edge of the first pair having at least two spaced projecting pins for engagement in the guide grooves as the intermediate floor member is lowered into the vault, each guide groove terminates at a closed end providing a stop for engagement by the respective pin to support the intermediate floor member at the desired height in the vault.

Preferably, more than two sets of opposing guide grooves and pins are provided and, in a preferred embodiment of the invention, five opposing pairs of grooves are provided in the opposite side walls, and five opposing pairs of pins project from the opposite side edges of the intermediate floor member. Preferably, the guide grooves are of gradually tapering width from the upper end towards the closed end, so as to allow the intermediate floor to slide smoothly down into the desired position without jamming.

With this arrangement, an intermediate floor can be readily positioned in a horizontal orientation to divide a vault into two separate chambers. The floor may be of relatively lightweight, plastic material rather than heavier concrete as was previously used for double depth crypts or vaults.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
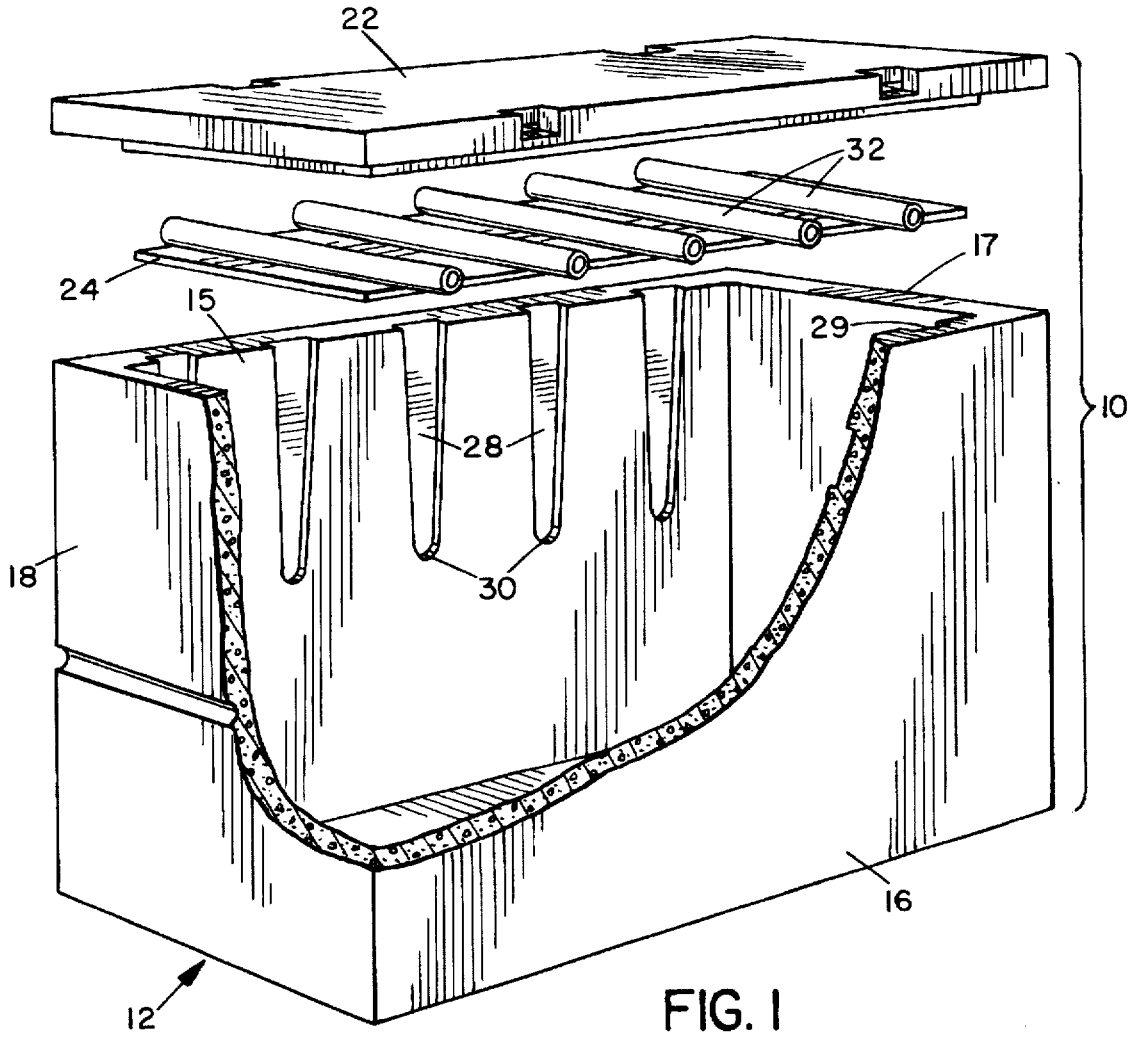
FIG. 1 is an exploded cut away perspective view of the crypt according to a preferred embodiment of the invention.

FIGS. 1–4 illustrate a double depth lawn crypt or vault assembly 10 according to a preferred embodiment of the present invention. The assembly includes a one-piece vault or crypt 12 having a floor 14, a pair of opposing side walls 15,16, and a pair of opposing end walls 17,18 forming a rectangular enclosure having an open upper end. A removable cover 22 is provided for closing the open upper end of crypt 12. The crypt 12 is of sufficient height to provide two vertically spaced burial chambers. An intermediate floor member 24 separates the enclosure into a lower chamber 25 and an upper chamber 26.

Intermediate floor member 24 is preferably a flat panel of relatively lightweight material, such as plastic, while the crypt 12 is preferably of reinforced concrete material. The roof or cover 22 is also of concrete material and preferably has least two spaced re-bars (not illustrated) embedded along its side edges. The opposing side walls 15,16 of the vault each have a series of spaced, vertical guide slots or grooves 28,29, respectively, extending from the open, upper end of the crypt 12 towards the floor. Each groove has a lower end or termination 30,31, respectively, at a location corresponding to the desired height of the intermediate floor member 24. Each groove 28 in one side wall 15 is aligned with a corresponding groove 29 in the opposite side wall 16. Although the opposing sets of guide grooves are provided at spaced intervals along the side walls in the illustrated embodiment, they may alternatively or additionally be provided in end walls 17,18 in an equivalent manner.

Figure 2:
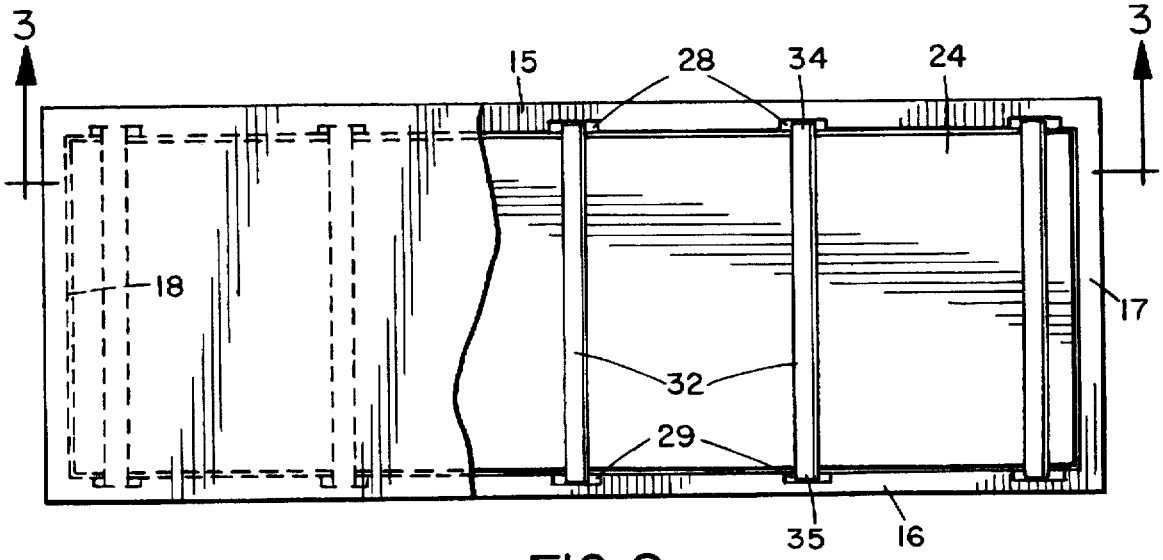
FIG. 2 is a top plan view, partially cut away, of the assembled crypt.
Figure 3:
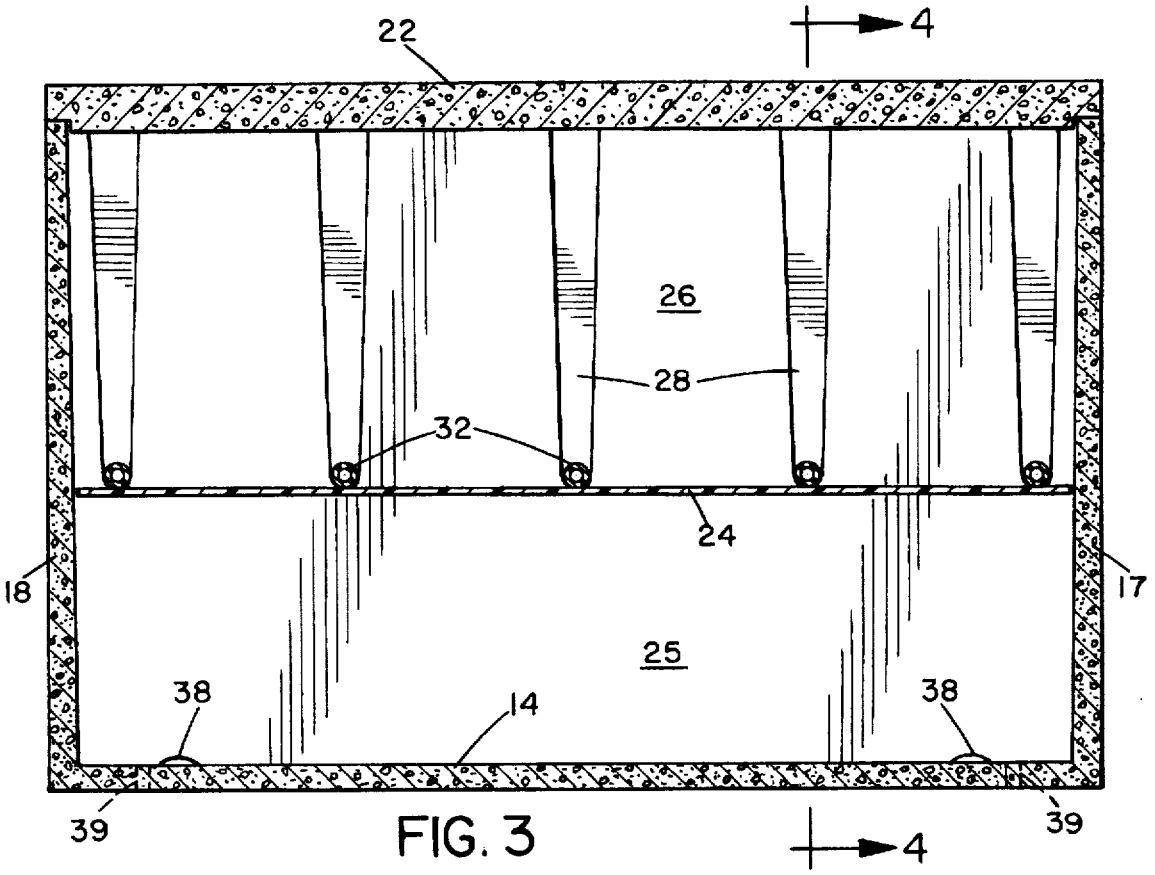
FIG. 3 is a sectional view taken on line 3—3 of FIG. 2.
Figure 4:
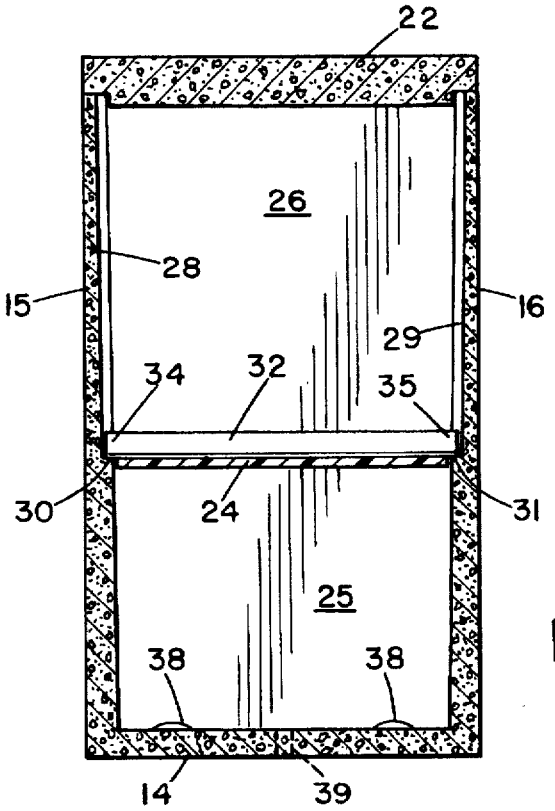
FIG. 4 is a sectional view taken on line 4—4 of FIG. 3.

The intermediate floor member 24 has a series of spaced, transversely extending rods or pipes 32 secured across its upper surface such that the opposite ends 34,35 of each rod or pipe project outwardly from the respective opposite side edges of the member 24 for engagement in the guide grooves 28,29. The number of rods or pipes 32 is therefore equal to the number of pairs of opposing guide grooves 28,29, and the rods are positioned for engagement in the respective pairs of grooves as best illustrated in FIGS. 2 and 3. Preferably, the rods 32 are of 1.5" P.V.C. pipe or equivalent strength material, and are suitably bonded or welded securely to the panel. In the preferred embodiment of the invention, a series of five pairs of evenly spaced guide grooves 28,29 and five correspondingly spaced rods are provided, although a greater or lesser number of guide grooves and engaging pins or pipes may be provided in alternative embodiments. However, a set of five pairs of grooves and five rods is believed to provide sufficient support for the intermediate floor and its ultimate load.

Preferably, each rod is bonded to the flat panel with a suitable adhesive, and is additionally secured in position by a series of spaced screws or similar fasteners (not illustrated). Each guide groove is of gradually tapering diameter from the open, upper end to the lower end 30,31, with the width across the lower end being slightly larger than the diameter of pipe 32. Preferably, the maximum width of the guide groove at its upper end is approximately twice the width at the lower end. With this arrangement, the intermediate floor can be readily lowered into position, simply by engaging the opposite ends of each pipe in the appropriate guide grooves, and then lowering the floor with the guide grooves smoothly guiding the floor downwardly into a level or horizontal orientation when the respective rod ends reach the lower ends of each pair of grooves, which act as a stop or support for the floor. Due to the gradually tapering width of the guide grooves, the risk of the intermediate floor jamming in position before the desired final position is reached is reduced or eliminated. Another advantage of the intermediate floor design of a flat panel with pipes or rods secured transversely across the upper surface of the panel is that the pipes provide gripping surfaces for easy lowering of the intermediate floor into position. A hoist or crane device with suitable gripper claws or clamps is preferably provided for this purpose. The claws or clamps are secured around two of the pipes 32, and the hoist or crane can then be actuated to lower the floor into the crypt. Once the floor is in position, the claws or clamps are readily released. This significantly reduces manpower in positioning of the intermediate floor, and simplifies the procedure considerably.

Instead of providing transverse rods with projecting ends for engaging the guide grooves, as in the illustrated embodiment, the intermediate floor may alternatively be provided with other types of projections at its opposite side edges to engage in grooves 28,29, such as spaced, projecting ears formed integrally with the plastic panel itself, for example. However, the illustrated embodiment is preferable since the transverse rods have the dual purpose of reinforcing and strengthening the floor itself as well as providing the groove-engaging projections, and providing gripping surfaces for easy lowering of the floor into the vault.

The crypt or vault will be typically be of conventional dimensions for double depth burials, and in a preferred embodiment vault 12 had a length of around 90" and a width of around 30". The five pairs of guide grooves and corresponding five pipes or rods were provided at a spacing of around 20" between each adjacent pair of grooves or rods. The lower and upper vault chambers 25,26 formed by the intermediate floor each had a height of around 25.5". The side walls and floor of the vault are preferably reinforced with conventional reinforcing wire. The vault floor 14 has raised bumps or projections 38 on which the casket rests, and has at least two drain holes 39.

The crypt or vault 12 will be interred below ground level with the intermediate floor 24 and roof 22 removed, leaving the upper end open. The first burial can then be carried out, lowering the casket down onto the floor 14. The intermediate floor 24 is then lowered as described above, until the rod ends 34,35 reach the lower ends of the grooves, as illustrated in FIG. 3. The roof 22 is then placed over the open upper end of the vault, and the entire assembly is covered with turf until it is time for the next burial. At that point, the vault is exposed and the roof 22 is removed to allow the second casket to be lowered onto the intermediate floor 24 in the upper burial chamber 26, so that it rests on the transverse rods or pipes 32. The roof 22 is then repositioned over the upper chamber, and the entire assembly is again covered with turf.

Although a preferred embodiment of the present invention has been described above by way of example only, it will be understood by those skilled in the field that modifications may be made to the disclosed embodiment without departing from the scope of the invention, which is defined by the appended claims.

I claim:

1. A vault assembly, comprising:

a vault having a floor, a first pair of opposing spaced side walls and a second pair of opposing spaced end walls forming a burial enclosure having an open upper end;

an intermediate floor member mounted in the enclosure at a predetermined location between said upper end and floor to divide said enclosure into a lower burial chamber and an upper burial chamber;

a removable cover closing the open upper end of the vault;

each wall of at least one of said pairs having at least two spaced guide grooves extending from said open end towards said floor and terminating at said predetermined location intermediate said open end and said floor;

each guide groove being aligned with a corresponding guide groove in the opposite wall of said pair; and the intermediate floor member having a first pair of opposite edges facing respective walls of said one pair of walls, each edge of said first pair having least two spaced projecting pins engaging in said guide grooves as the intermediate floor member is lowered into the vault, each guide groove having a closed end providing a stop engaged by the pin to support the intermediate floor member in the vault.

2. The assembly as claimed in claim 1, wherein each wall of said one pair has a series of five spaced guide grooves aligned with corresponding guide grooves in the other wall of said pair, and each edge of said first pair of edges of said floor member has a series of five spaced projecting pins engaging in said respective guide grooves.

3. The assembly as claimed in claim 1, wherein each guide groove is of gradually tapering width from the upper end towards the closed end.

4. The assembly as claimed in claim 3, wherein each pin has a first diameter, and the closed end of each guide groove has a width substantially equal to said first diameter.

5. The assembly as claimed in claim 4, wherein each guide groove has an upper, open end of maximum width substantially equal to twice the width at said closed end.

6. The assembly as claimed in claim 1, wherein said intermediate floor member comprises a flat panel having an upper surface, and a series of spaced rods secured transversely across said upper surface, the panel being of predetermined width and each rod having a length greater than said predetermined width, each rod having opposite ends projecting outwardly from the opposite edges of said floor member, said projecting ends of said rods comprising said pins engaging in said guide grooves.

7. The assembly as claimed in claim 6, wherein said panel is of plastic material.

8. The assembly as claimed in claim 7, wherein said rods are plastic pipes.

* * * * *